US007150100B2

(12) United States Patent
Tase et al.

(10) Patent No.: US 7,150,100 B2
(45) Date of Patent: Dec. 19, 2006

(54) METHOD OF FORMING A JACKETED STEAM DISTRIBUTION TUBE

(75) Inventors: Warren A. Tase, Three Rivers, MI (US); Rex Cheskaty, Stuart, FL (US); Paul Grandlinard, Mendon, MI (US)

(73) Assignee: Armstrong International, Inc., Three Rivers, MI (US)

( * ) Notice: Subject to any disclaimer, the term of this patent is extended or adjusted under 35 U.S.C. 154(b) by 71 days.

(21) Appl. No.: 10/887,689

(22) Filed: Jul. 9, 2004

(65) Prior Publication Data

US 2006/0005387 A1 Jan. 12, 2006

(51) Int. Cl.

| | |
|---|---|
| ***B21D 39/06*** | (2006.01) |
| ***B21D 53/08*** | (2006.01) |
| ***F28C 3/06*** | (2006.01) |
| ***F16L 9/19*** | (2006.01) |

(52) U.S. Cl. ..... 29/890.036; 29/455.1; 29/525; 261/115; 261/159; 261/DIG. 76; 138/114

(58) Field of Classification Search ..... 29/890.036, 29/455.1, 525; 72/269; 138/112, 113, 114; 492/47; 261/115, 159, DIG. 76
See application file for complete search history.

(56) References Cited

U.S. PATENT DOCUMENTS

| | | | | |
|---|---|---|---|---|
| 3,429,171 | A | 2/1969 | Feher | |
| 3,626,987 | A | 12/1971 | Bittner | |
| 3,724,180 | A | 4/1973 | Morton et al. | |
| 3,777,502 | A * | 12/1973 | Michie et al. | 62/50.7 |
| 3,939,683 | A | 2/1976 | van Geffen | |
| 3,976,129 | A * | 8/1976 | Silver | 165/154 |
| 4,084,943 | A * | 4/1978 | Hamel et al. | 95/32 |
| 4,132,097 | A | 1/1979 | Ames | |
| 4,185,466 | A * | 1/1980 | Muntz | 62/55.5 |
| 4,185,486 | A | 1/1980 | van Geffen | |
| 4,265,840 | A * | 5/1981 | Bahler | 261/115 |
| 4,372,374 | A | 2/1983 | Lee | |
| 4,428,214 | A | 1/1984 | Head, Jr. et al. | |
| 4,444,622 | A | 4/1984 | Dove | |
| 4,454,741 | A | 6/1984 | Hoogenboom | |
| 4,585,059 | A | 4/1986 | Lee | |
| 4,658,486 | A * | 4/1987 | Schonemann | 492/46 |
| 4,678,577 | A | 7/1987 | Thomas et al. | |
| 4,758,392 | A | 7/1988 | Collins et al. | |
| 4,906,496 | A * | 3/1990 | Hosono et al. | 428/36.9 |
| 5,108,539 | A | 4/1992 | Kelley et al. | |
| 5,516,466 | A | 5/1996 | Schlesch et al. | |
| 5,580,622 | A * | 12/1996 | Lockshaw et al. | 428/34.1 |
| 5,593,120 | A | 1/1997 | Hamerski | |
| 5,632,300 | A * | 5/1997 | Isringhausen | 137/269 |
| 5,942,163 | A | 8/1999 | Robinson et al. | |
| 5,953,924 | A | 9/1999 | Li et al. | |
| 5,997,822 | A | 12/1999 | Komai et al. | |

(Continued)

OTHER PUBLICATIONS

Humidification Solution Source, Bulletin 596 20M, Mar. 2002, by Armstrong International, Inc. pp. 48-49.

*Primary Examiner*—David P. Bryant
*Assistant Examiner*—Sarang Afzali
(74) *Attorney, Agent, or Firm*—MacMillan, Sobanski & Todd, LLC

(57) ABSTRACT

A method of forming a jacketed steam distribution tube assembly includes simultaneously extruding an inner tube, an outer tube, and a plurality of connecting members for connecting the inner tube to the outer tube, thereby forming a jacketed steam distribution tube assembly.

14 Claims, 3 Drawing Sheets

U.S. PATENT DOCUMENTS

| | | | | |
|---|---|---|---|---|
| 6,032,391 | A | 3/2000 | Yao | |
| 6,038,768 | A | 3/2000 | Rhodes | |
| 6,065,740 | A | 5/2000 | Morton | |
| 6,153,035 | A | 11/2000 | Van Laeken | |
| 6,171,427 | B1 | 1/2001 | Hess et al. | |
| 6,199,916 | B1 | 3/2001 | Klinger et al. | |
| 6,227,526 | B1 | 5/2001 | Morton | |
| 6,378,562 | B1 * | 4/2002 | Noone et al. | 138/137 |
| 6,485,537 | B1 | 11/2002 | Brilmaker | |
| 6,755,399 | B1 * | 6/2004 | Shimanuki et al. | 261/104 |
| 2001/0015500 | A1 * | 8/2001 | Shimanuki et al. | 261/104 |

* cited by examiner

METHOD OF FORMING A JACKETED STEAM DISTRIBUTION TUBE

BACKGROUND OF THE INVENTION

The present invention relates generally to a steam distribution tube, and more particularly to an improved method of forming a jacketed steam distribution tube.

Steam humidification systems are commonly used to raise the humidity level in airflow ducts. Typical untreated air in the winter months has very low relative humidity, and it is desirable to increase the level of humidity in commercial and industrial facilities. This is particularly true for health care facilities such as hospitals and nursing homes. High relative humidity is also needed in industrial locations where static electricity is especially undesirable, such as in facilities housing electronic equipment, and in other industrial locations, such as fabric or paper handling, where a material must be prevented from drying out.

Steam humidification systems typically use dispersion tubes that are supplied with steam and have numerous orifices to discharge steam. Usually the dispersion tubes are positioned within air handling systems such as heating, ventilating and air conditioning (HVAC) ducts to discharge steam into the air flowing through the ducts. Since the steam is warmer than the air flowing through the HVAC ducts, the airflow in the ducts has a cooling effect on the dispersion tubes. As the steam enters the dispersion tubes, some of the steam is cooled to the extent that it condenses into water. This is to be avoided because the water can be discharged through the discharge orifices in liquid form along with the steam in vaporous form. The result is undesirable dampness in the HVAC duct and other equipment.

Designers of steam humidification systems know that the tendency of steam to condense in the dispersion tube can be counteracted by providing a heated jacket around the dispersion tube to help maintain the dispersion tube warm enough so that condensation does not occur. A flow of steam through the jacket passageway keeps the dispersion tube from cooling off, thereby minimizing condensation in the dispersion tube. Known steam humidification systems also include a support structure attached within the jacket for attaching the steam tubes and aligning each of a plurality of orifices in the steam tube with each of a plurality of discharge orifices in each jacket. The process of manufacturing and assembling the dispersion tube and the support structure within the jacket, and aligning the orifices of the steam tube with the orifices of the jacket, increases the cost and difficulty of manufacture of the steam humidification system. It would therefore be advantageous to provide an improved method for forming a jacketed manifold and/or a jacketed steam distribution tube.

SUMMARY OF THE INVENTION

The present invention relates to a method of forming a jacketed steam distribution tube assembly. The method includes simultaneously extruding an inner tube, an outer tube, and a plurality of connecting members for connecting the inner tube to the outer tube, thereby forming a jacketed steam distribution tube assembly.

In another embodiment of the invention, a method of forming a jacketed steam distribution tube assembly includes forming an outer tube, forming an inner tube, forming first and second connecting members extending radially outward of the inner tube and connecting the inner tube to the outer tube. A plurality of steam orifices are then formed in the first connecting member, such that the steam orifices extend between an inner surface of the inner tube and an outer surface of the outer tube, thereby forming a jacketed steam distribution tube assembly.

In another embodiment of the invention, a method of forming a jacketed steam distribution tube assembly includes simultaneously extruding an inner tube, an outer tube, and a plurality of connecting members for connecting the inner tube to the outer tube, thereby forming a jacketed steam distribution tube assembly having a first predetermined length. The first predetermined length of the jacketed steam distribution tube assembly is then divided into a plurality of jacketed steam distribution tube portions.

Other advantages of this invention will become apparent to those skilled in the art from the following detailed description of the invention, when read in light of the accompanying drawings.

DETAILED DESCRIPTION OF THE INVENTION

Figure 1:
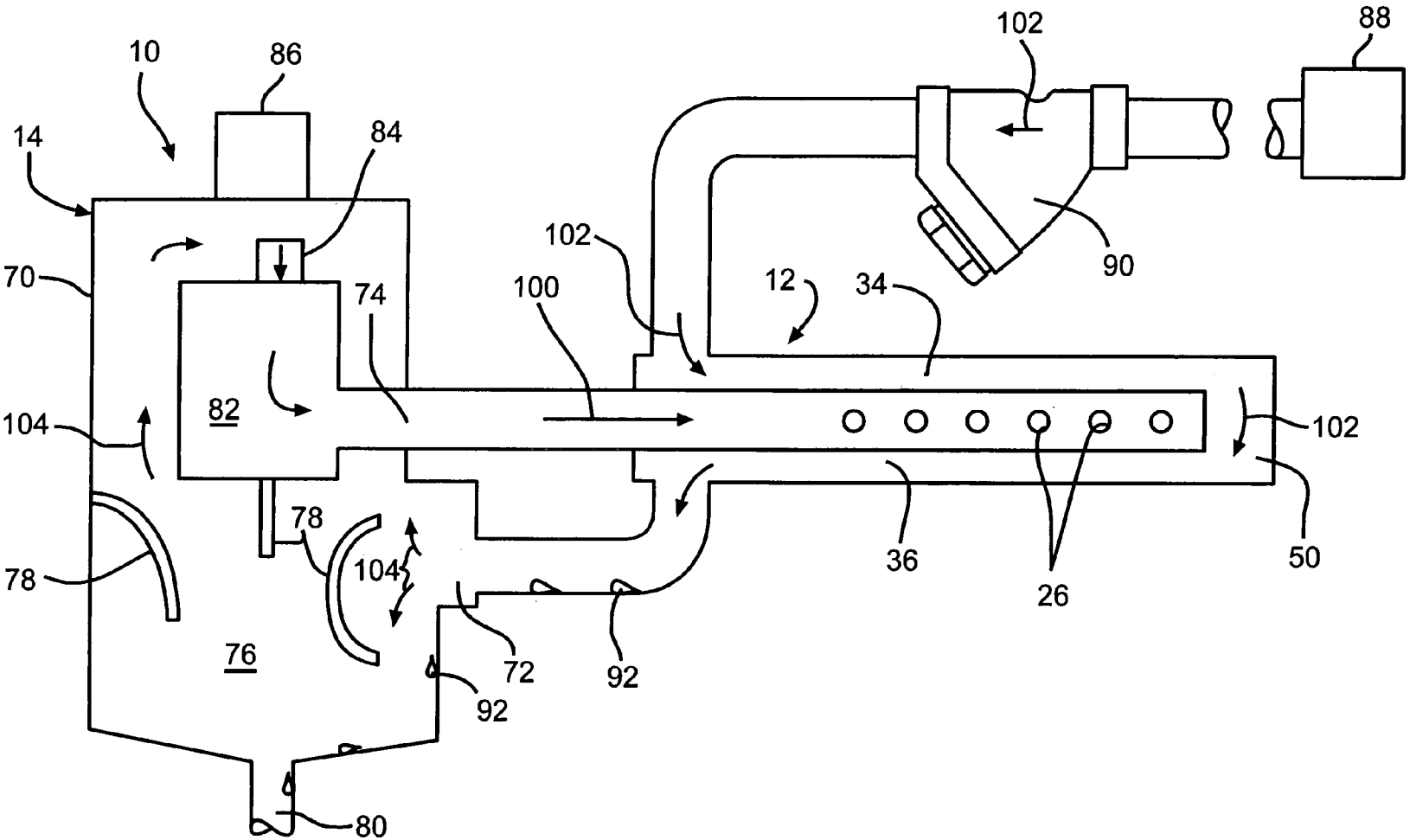
FIG. 1 is a schematic view in elevation of steam humidification system according to the invention.
Figure 2:
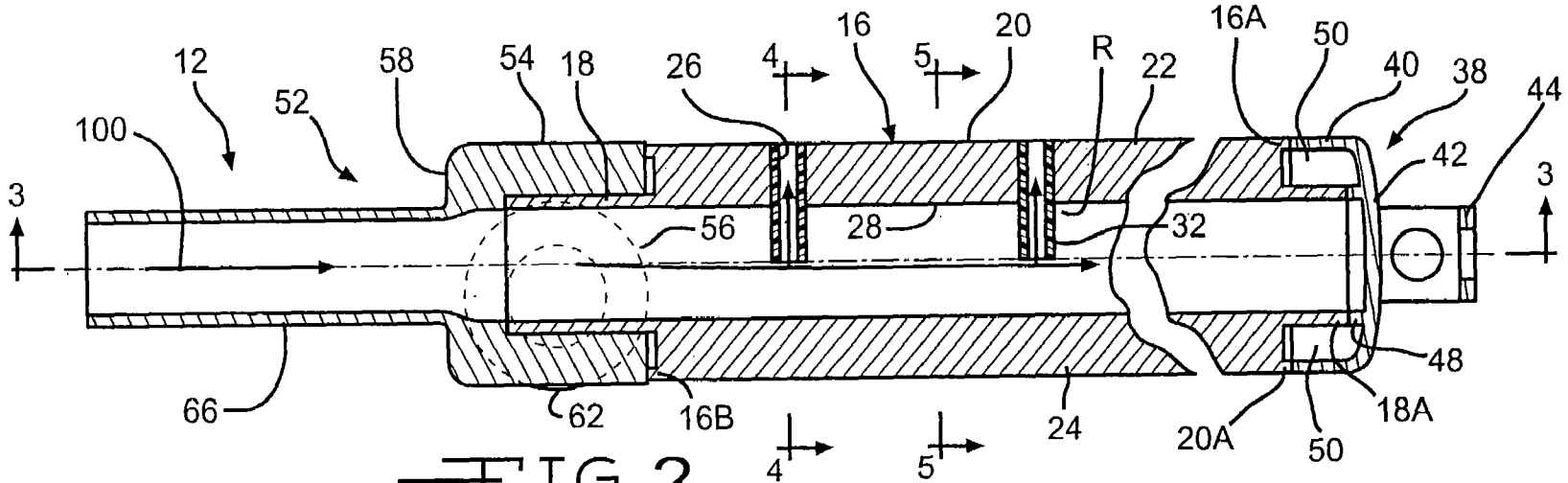
FIG. 2 is a cross-sectional view in elevation of the jacketed steam distribution tube assembly taken along line 2—2 of FIG. 3.
Figure 3:
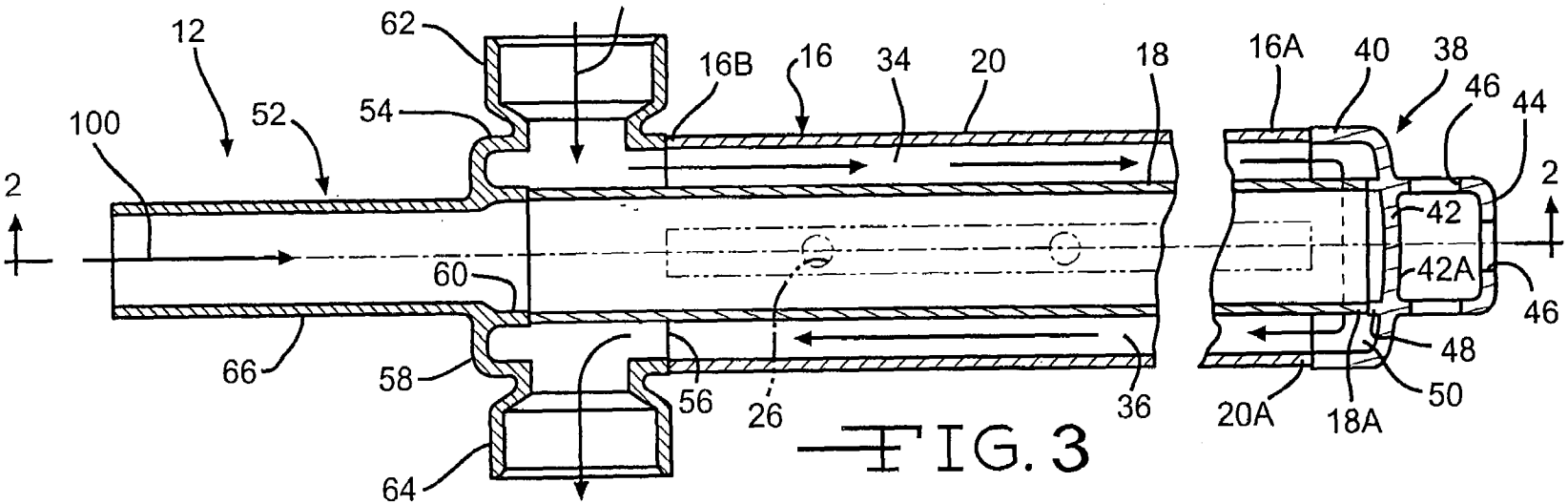
FIG. 3 is a cross-sectional view in elevation of the jacketed steam distribution tube assembly taken along line 3—3 of FIG. 2.

Referring to FIG. 1, there is schematically illustrated generally at 10 an exemplary embodiment of a steam humidification system. The steam humidification system 10 includes a jacketed steam distribution tube assembly 12 manufactured according the method of the present invention and a steam conditioner 14. As best shown in FIGS. 2 and 3, the jacketed steam distribution tube assembly 12 includes a body 16 having a first end 16A, a second end 16B, an inner or distribution tube 18, an outer tube or jacket 20, and a plurality of connecting members or webs 22, 24. The distribution tube 18 and the jacket 20 can be formed having any suitable wall thickness. Preferably, the distribution tube 18 and the jacket 20 are formed having a wall thickness within the range of from about 0.105 inch to about 0.115 inch. More preferably, the distribution tube 18 and the jacket 20 are formed having a wall thickness about 0.110 inch.

Figure 5:
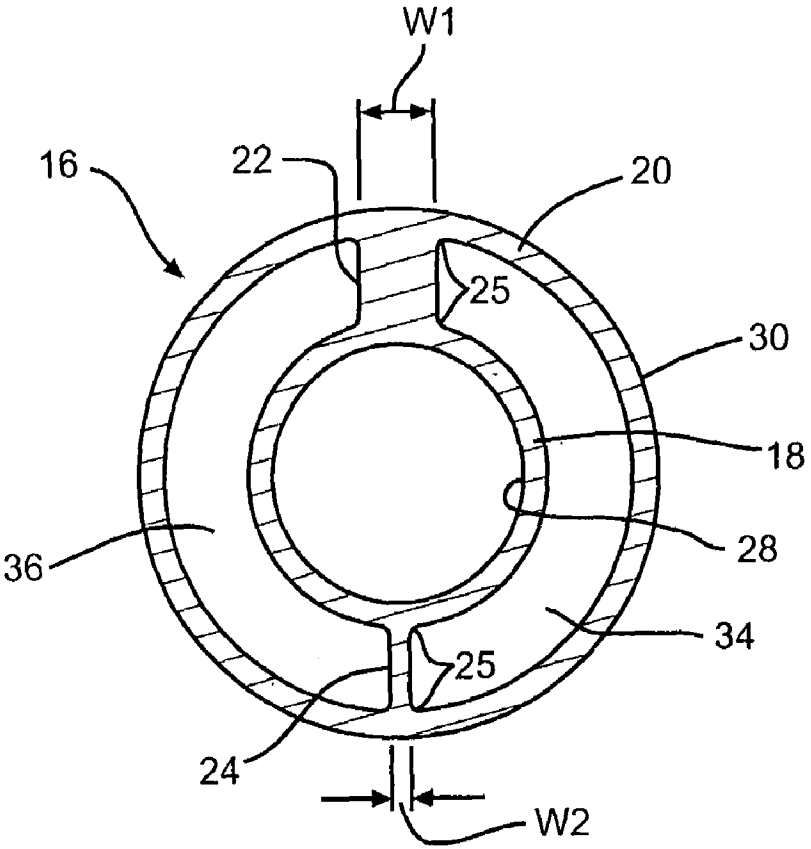
FIG. 5 is an enlarged cross-sectional view of a portion of the jacketed steam distribution tube assembly taken along line 5—5 of FIG. 2.
Figure 4:
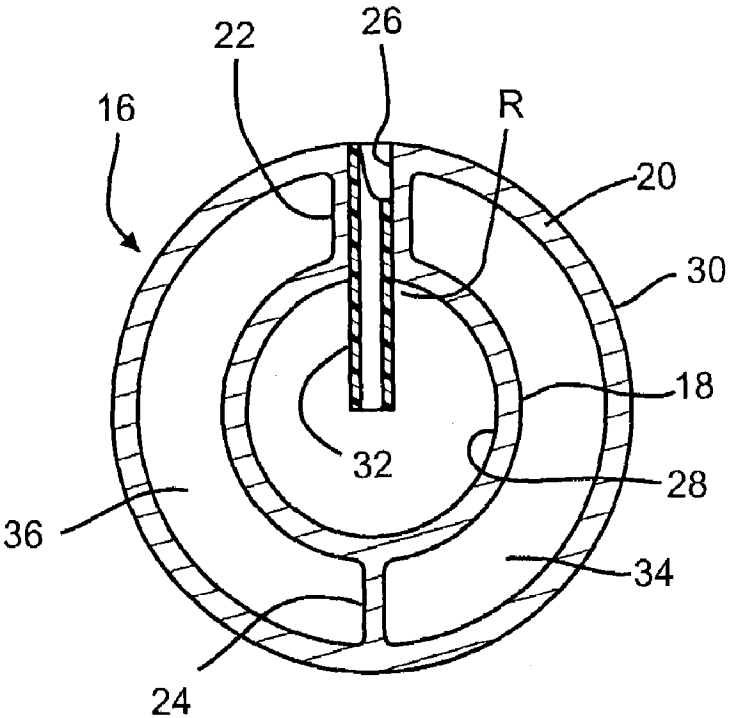
FIG. 4 is an enlarged cross-sectional view of a portion of the jacketed steam distribution tube assembly taken along line 4—4 of FIG. 2.

The webs 22, 24 extend longitudinally and radially outward of the distribution tube 18 to the jacket 20 and connect the distribution tube 18 to the jacket 20, as best shown in FIGS. 3 through 5, inclusive. Preferably the body 16 comprises a first web 22 and a second web 24 disposed about 180 degrees apart. The webs 22, 24 are shown as having a substantially rectangular cross-section. It will be understood however, that the webs 22, 24 can have any desired cross sectional shape. The webs 22, 24 are further shown in FIG. 5 as having different widths w1, w2, respectively. It will be understood however, that the webs 22, 24 can have any desired width.

An inside surface or fillet 25 is formed between the first web 22 and the jacket 20, the first web 22 and the distribution tube 18, the second web 24 and the jacket 20, and the second web 24 and the distribution tube 18. Preferably, the fillet 25 is formed having a radius within the range of from about 0.057 inch to about 0.067 inch. More preferably, the fillet 25 has a radius of about 0.062 inch.

An orifice 26 is formed radially outwardly through the web 22, between an inner surface 28 of the distribution tube 18 and an outer surface 30 of the jacket 20. Preferably, a plurality of orifices 26 is formed radially outwardly through the web 22. More preferably, the plurality of orifices 26 are linearly arrayed and spaced apart throughout the length of the body 16. It will be understood that the orifices 26 can be formed by any desired method, such as for example, by drilling.

A condensate flow barrier tube 32 is preferably disposed in each orifice 26, and extends inwardly from the jacket 20 to a point inward of the inner surface 28 of the distribution tube 18. Preferably, the condensate flow barrier tubes 32 are attached within the orifices 26 with an interference fit. It will be understood however, that the condensate flow barrier tubes 32 can be attached to the orifices 26 by any other desired means. The condensate flow barrier tubes 32 ensure that any condensed, liquid water that may be formed within the distribution tube 18, is trapped in a region R about the condensate flow barrier tube 32 and prevented from exiting the distribution tube 18 through the orifices 26. It will be further understood however, that if desired, the body 16 can be formed without condensate flow barrier tubes 32.

As best shown in FIGS. 2, 4, and 5, the webs 22, 24 form a first passageway 34 and a second passageway 36 between the distribution tube 18 and the jacket 20. As will be explained in detail below, the first and second passageways 34 and 36 define flow paths for steam. Preferably, as shown in FIGS. 2 through 5, inclusive, the distribution tube 18 and the jacket 20 are preferably substantially concentric, although such concentricity is not required. Because the distribution tube 18 and the jacket 20 are substantially concentric, and because the webs 22, 24 are disposed about 180 degrees apart, the first and second passageways 34 and 36 are substantially equal in size.

The distribution tube 18, jacket 20, and webs 22, 24 of the body 16 of the jacketed steam distribution tube assembly 12 are preferably formed simultaneously. More preferably, the distribution tube 18, jacket 20, and webs 22, 24 of the body 16 are formed by extrusion. The body 16 can be formed from any desired metal, such as aluminum, or any desired thermoplastic, such as polysulfone. It will be understood however, that the body 16 can also be formed from any other desired metals and non-metals. Preferably, virgin aluminum is used. It has been shown that other types of aluminum, such as non-virgin aluminum, recycled aluminum, or aluminum containing other metals or alloys, performs unsatisfactorily during the extrusion process.

The extrusion process can be performed using any desired extruding machine. One example of such an extruding machine is a 2000 ton, 7 inch extrusion press manufactured by the Sutton Division of SMS Eumuco, Inc. of Pittsburgh, Pa.

The body 16 can be extruded to a first predetermined length. It will be understood that the first predetermined length of the body 16 can be any desired length as required for storage and shipping. Once extruded, the first predetermined length of the body 16 can be further divided into a plurality of jacketed steam distribution portions. An example of such a jacketed steam distribution portion is the body 16 illustrated in FIGS. 2 and 3. The jacketed steam distribution portions can be any desired lengths, such as for example, within the range of from about one foot to about 12 feet in length.

A first cap 38 is disposed at the first end 16A of the body 16 and includes a substantially cylindrical outer wall 40 and a closed end 42. A substantially U-shaped mounting flange 44 extends outwardly from a surface 42A of the closed end 42. If desired, the flange 44 can include a plurality of apertures 46 for receiving fasteners (not shown) for attaching the jacketed steam distribution tube assembly 12 within a duct. An annular inner wall 48 is formed radially inward of the outer wall 40. The inner and outer walls 48 and 40 define an annular passageway 50.

Preferably, the inner wall 48 of the first cap 38 is attached to a first end 18A of the distribution tube 18. The outer wall 40 of the first cap 38 is attached to a first end 20A of the jacket 20. The first cap 38 can be attached to the first end 16A of the body 16 by any desired method, such as by friction welding. When the first cap 38 is attached to the first end 16A of the body 16, the closed end 42 of the first cap 38 seals the distribution tube 18 and prevents the flow of steam therefrom. The annular passageway 50 fluidly connects the first passageway 34 to the second passageway 36.

A second cap or connector 52 is disposed at the second end 16B of the body 16 and includes a substantially cylindrical outer wall 54, a first or open end 56, and a second end 58. An annular inner wall 60 is formed radially inward of the outer wall 54. A first steam inlet 62 and a steam outlet 64 are formed in the outer wall 54. Preferably the first steam inlet 62 and the steam outlet 64 are formed about 180 degrees apart. A second steam inlet 66 extends outwardly from the second end 58.

The connector 52 can be attached to the second end 16B of the body 16 by any desired method, such as by friction welding. The second steam inlet 66 is preferably connected to a source of dry steam, as will be described below. When the connector 52 is attached to the second end 16B of the body 16, the second steam inlet 66, the inner wall 60, and the distribution tube 18 define a flow path for the dry steam, as illustrated by an arrow 100 in FIGS. 1 through 3, inclusive. The first steam inlet 62 fluidly connects the first passageway 34 to a source of steam 88. The steam outlet 64 fluidly connects the second passageway 34 to the steam conditioner 14.

The steam conditioner 14 is schematically illustrated in FIG. 1 and provides a source of dry steam. The steam conditioner 14 includes a housing 70 having a housing inlet 72 and a housing outlet 74. The housing 70 is formed from any desired material, such as cast iron.

A separating chamber 76 is formed in a lower portion of the housing 70. Preferably, the separating chamber 76 includes a plurality of baffles 78 to reduce the velocity of, and separate any condensate from, the steam. The interior walls of the separating chamber 76 and the baffles 78 can have any desirable shape or configuration. A drain 80 is formed in a lower surface of the separating chamber 76 to allow condensate to flow out of the separating chamber 76.

A drying chamber 82 is provided within the housing 70. Preferably, the drying chamber 82 is disposed within the separating chamber 76. A metering valve 84 is disposed between separating chamber 76 and the drying chamber 82. A controller 86 controls actuation of the metering valve 84.

In operation, steam moves (as illustrated by arrows 102 in FIG. 1) from the source of steam 88 to the first steam inlet 62. If desired, an in-line strainer 90 can be disposed between the source of steam 88 and the first steam inlet 62 to remove particulate matter from the steam. The steam then moves through the first passageway 34, the annular passageway 50, and the second passageway 36 to the steam outlet 64.

The steam then moves through the separating chamber 76 (as illustrated by arrows 104 in FIG. 1) wherein the baffles 78 condition the steam by reducing its velocity and maximizing the separation of water droplets 92 therefrom. The steam then moves through the metering valve 84 to the drying chamber 82.

The steam from the separating chamber 76 can carry undesirable liquid mist or water droplets 92 (i.e. condensate). As schematically illustrated in FIG. 1, the drying chamber 82 is preferably surrounded by the steam of the separating chamber 76, and the steam in the separating chamber 76 is preferably at supply temperature. Any water droplets 92 in the steam entering the drying chamber 82 can be re-evaporated, thereby providing dry steam. As used herein, the term dry steam is defined as steam having substantially no water droplets 92 therein. If desired, a silencing material, such as a stainless steel silencing material (not shown) can be disposed in the drying chamber 82 to absorb the noise of steam moving through the metering valve 84, and through the drying chamber 82. Dry steam then moves through the distribution tube 18 (as illustrated by the arrow 100 in FIG. 1) and outwardly through the orifices 26.

The principle and mode of operation of this invention have been described in its preferred embodiment. However, it should be noted that this invention may be practiced otherwise than as specifically illustrated and described without departing from its scope.

What is claimed is:

1. A method of forming a jacketed steam distribution tube assembly, the method comprising:

simultaneously extruding:

an inner tube;

an outer tube; and a plurality of connecting members for connecting the inner tube to the outer tube, thereby forming a jacketed steam distribution tube assembly;

forming a plurality of orifices radially outwardly through one of the connecting members between an inner surface of the inner tube and an outer surface of the outer tube; and disposing condensate flow barrier tubes in the orifices, the condensate flow barrier tubes extending from the outer tube to a point inward of an inner surface of the inner tube.

2. The method according to claim 1, wherein the inner tube and the outer tube are concentric.

3. The method according to claim 1, wherein the inner tube, the outer tube, and the plurality of connecting members are formed from aluminum.

4. The method according to claim 1, wherein the condensate flow barrier tubes are attached within the orifices with an interference fit.

5. The method according to claim 1, wherein the plurality of connecting members comprise a pair of connecting members radially disposed about 180 degrees apart.

6. The method according to claim 5, wherein the pair of connecting members defines a first passageway and a second passageway between the inner tube and the outer tube.

7. The method according to claim 6, wherein the method further includes attaching a first cap to a first end of the jacketed steam distribution tube assembly, the first cap sealing a first end of the inner tube, and the first cap fluidly connecting the first passageway to the second passageway.

8. The method according to claim 6, wherein the method further includes attaching a second cap to a second end of the jacketed steam distribution tube assembly, the second cap defining a first steam inlet fluidly connected to the first passageway, a steam outlet fluidly connected to the second passageway, and a second steam inlet fluidly connected to the inner tube.

9. The method according to claim 8, wherein the first steam inlet is further connected to a source of steam, the second steam inlet is connected to source of dry steam.

10. A method of forming a jacketed steam distribution tube assembly, the method comprising:

forming an outer tube;

forming an inner tube;

forming a first connecting member extending radially outward of the inner tube and connecting the inner tube to the outer tube;

forming a second connecting member extending radially outward of the inner tube and connecting the inner tube to the outer tube;

forming a plurality of steam orifices in the first connecting member, the steam orifices extending between an inner surface of the inner tube and an outer surface of the outer tube, thereby forming a jacketed steam distribution tube assembly; and disposing condensate flow barrier tubes in the orifices, the condensate flow barrier tubes extending from the outer tube to a point inward of an inner surface of the inner tube.

11. The method according to claim 10, wherein the first and the second connecting members are disposed about 180 degrees apart.

12. The method according to claim 10, wherein the inner tube and the outer tube are concentric.

13. The method according to claim 10, wherein the inner tube, the outer tube, and the plurality of connecting members are formed from metal.

14. The method according to claim 13, wherein the inner tube, the outer tube, and the plurality of connecting members are formed from aluminum.

* * * * *